United States Patent [19]

Githens

[11] 4,102,321

[45] Jul. 25, 1978

[54] FIREPLACE SCREEN

[76] Inventor: Norman Githens, 8 Dolphin Dr., Massapequa, N.Y. 11758

[21] Appl. No.: 773,598

[22] Filed: Mar. 2, 1977

[51] Int. Cl.[2] ..... F24C 15/12

[52] U.S. Cl. ..... 126/140; 126/202; 160/DIG. 9; D7/208

[58] Field of Search ..... 126/138, 139, 140, 202; 160/DIG. 9; D7/208

[56] References Cited

U.S. PATENT DOCUMENTS

| | | | |
|---|---|---|---|
| 2,841,219 | 7/1958 | Helwig | 126/140 |
| 3,457,907 | 7/1969 | Brunig | 126/140 |
| 3,870,032 | 3/1975 | Lydle et al. | 126/202 |
| 3,894,527 | 7/1975 | Ickes | 126/140 |
| 3,913,558 | 10/1975 | Caldwell | 126/139 |
| 4,027,650 | 6/1977 | Edwards | 126/140 |

*Primary Examiner*—Ronald C. Capossela

*Attorney, Agent, or Firm*—Robert D. Farkas

[57] ABSTRACT

A fireplace screen for substantially entirely covering a fireplace fuel burning chamber so as to preclude the continuous flow of air therein utilizes a rigid frame to which a first air impervious rigid sheet is fixedly secured and to which a second air impervious rigid sheet is slidably attached. Three accordian pleated members extend downwardly from the frame and provide a pair of openings through which a portion of the andirons commonly utilized with fireplaces extend to a position forward from the screen. The accordian-like members may be extended into a closed position in those installations wherein andirons are not employed. A plurality of permanent magnets are affixed to the rearmost surfaces of the frame, permitting the screen to be removably attached to fireplace structures having ferromagnetic members affixed adjacent to the open mouth portions thereof.

5 Claims, 5 Drawing Figures

FIREPLACE SCREEN

BACKGROUND OF THE INVENTION

1. Field of the Invention

This invention relates to fireplace screens and more particularly to that class partially or totally limiting the flow of air therethrough.

2. Description of the Prior Art

The prior art abounds with fireplace screens substantially, totally or adjustably impervious to the flow of air. U.S. Pat. No. 3,870,032 issued on Mar. 11, 1975 to J. E. Lydle et al. teaches a fireplace front or screen for fitting over fireplace opening which has self-supportingly rigid, rectangular supportive frame including rigid top, bottom and opposite side supportive strips defining frame opening and separate top, bottom and side facing strips of relatively thin, facing material, of selectively variable decorative designs, complementally fitted and affixed over the corresponding frame supportive strips. Frame carries heat-proof glass panel means, and at least one of top and bottom supportive and facing strips forms chamber for concealed draft means adjustable to control inward passage of draft air therethrough.

U.S. Pat. No. 3,913,558 issued on Oct. 21, 1975 to B. L. Caldwell pertains to folding glass doors that have a novel pivotal mounting for easy removal for cleaning. An optional wire mesh curtain may be mounted behind the doors. A draft control at the bottom of the frame is adjustable by a foot or hand operated lever. Installation of the frame is facilitated by an improved lintel bracket.

Both of the aforementioned patents suffer the common deficiency of providing draft means, though adjustable, facilitating the ongoing combustion of ignited fuel in fireplace chamber. Furthermore, both of the aforementioned disclosures fail to provide a light tight screen capable of concurrently hiding the fireplace combustion chamber from view whilst allowing the frontmost portions of an andiron set to be located forward of such a light tight and substantially airtight screen.

SUMMARY OF THE INVENTION

A primary object of the present invention is to provide a fireplace screen which chokes the flow of air to a burning combustible within the fireplace chamber, thereby causing the combustion process to be rapidly extinguished.

Another object is to provide a fireplace screen which provides virtually absolute safety against flying embers forcibly leaving the fire chamber.

Still another object is to provide a substantially airtight fire screen which permits portions of andirons to pass through openings therein.

Yet another object is to provide a fireplace screen which may be magnetically removably attached to ferromagnetic elements located adjacent the fireplace chamber opening.

A further object is to provide a fireplace screen whose solid sheet-like surfaces carry decorative and pleasing indicia.

Another object is to provide a fire retarding fireplace screen which may be installed in front of a conventional screen.

Heretofore, fireplace screens were employed taking into account the ability of the screen to prevent embers from leaving the combustion chamber and coming into contact with portions of the room housing the fireplace opening. Wire mesh, grills, glass sheets or other obstructions constitute some of the barriers employed to deflect burning embers. In those apparatus which utilize solid sheets, such as glass, damper arrangements have been provided so as to regulate the flow of air into the burning chamber.

The prior art devices are principly designed for use during an active combustion process rather than providing an apparatus which tends to limit or extinguish combustion whilst precluding visual access to the fire chamber. The present invention discloses such an apparatus which allows the user to quickly terminate the burning process and to provide a decorative solid screen concealing from view the light eminating from the combustible material and, after extinguishment, the combustible material itself. The need to "babysit" a fire until total extinguishment out of fear that an ordinary screen will not adequately protect the furnighings of the room housing the fireplace is thus eliminated.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a rectangular frame having uppermost, lowermost and opposed side members fabricated from a material having a U-shape or channel-like cross-section. The frame has frontmost and rearmost surfaces. The rearmost surface is provided with a plurality of permanent magnets fixedly secured thereto so that the frame may be magnetically secured to a ferromagnetic portion of the fireplace located adjacent the opening of the fire box or to an existing fireplace screen removably or fixedly installed over the fireplace opening.

A portion of the opening of the frame is covered by a stationery, rigid, solid, fire retardant sheet, such as asbestos board, The remaining portions of the opening of the frame may be covered by a similar fire retardant sheet that is slidably affixed within the channel-like groove of the frame. Thus, both sheets may be disposed so as to totally cover the opening in the frame or if desired, be disposed so that the sliding fire retardant sheet may be located partially juxtaposed with the stationery fire retardant sheet, thereby providing an opening through which the user may gain visual access to the fire chamber when the present invention is installed covering the opening of the fire chamber.

The frontmost surfaces of the fire retardant sheets may carry pleasing and decorative indicia, such as simulated wire mesh, outdoor scenes and the like.

The lowermost channel-like member of the frame is attached to an inverted frame-like member carrying the uppermost edge of pleated, accordian-like structures. Three such structures, each preferably fabricated from strips of sheet metal pivotably secured to each other, have the uppermost marginal edges thereof reside in the inverted U-shaped member. The lowermost marginal edges of the three accordian-like members reside in three lengths of opposed channel-like members, each being separated from one another in the area in which andirons are normally located. The pivotable axis joining adjacent pleated elements of the accordian-like members are located in a vertical direction enabling each accordian-like member to be contracted or extended in a horizontal line parallel to the hearth of the fireplace. Thus, the foremost portions of andirons may rest on the hearth of the fireplace at locations forward of the present invention by having portions of the andirons pass through the two openings formed between the three accordian-like members when partially retracted. When fully extended, the three accordian-like members comprise a closure for the opening beneath thr frame, thereby totally precluding the passage of air therethrough. Supporting legs may be affixed to the frame so as to cause the frame to tightly engage the fireplace opening in those installations in which the permanent magnets cannot be successfully employed.

Figure 1:
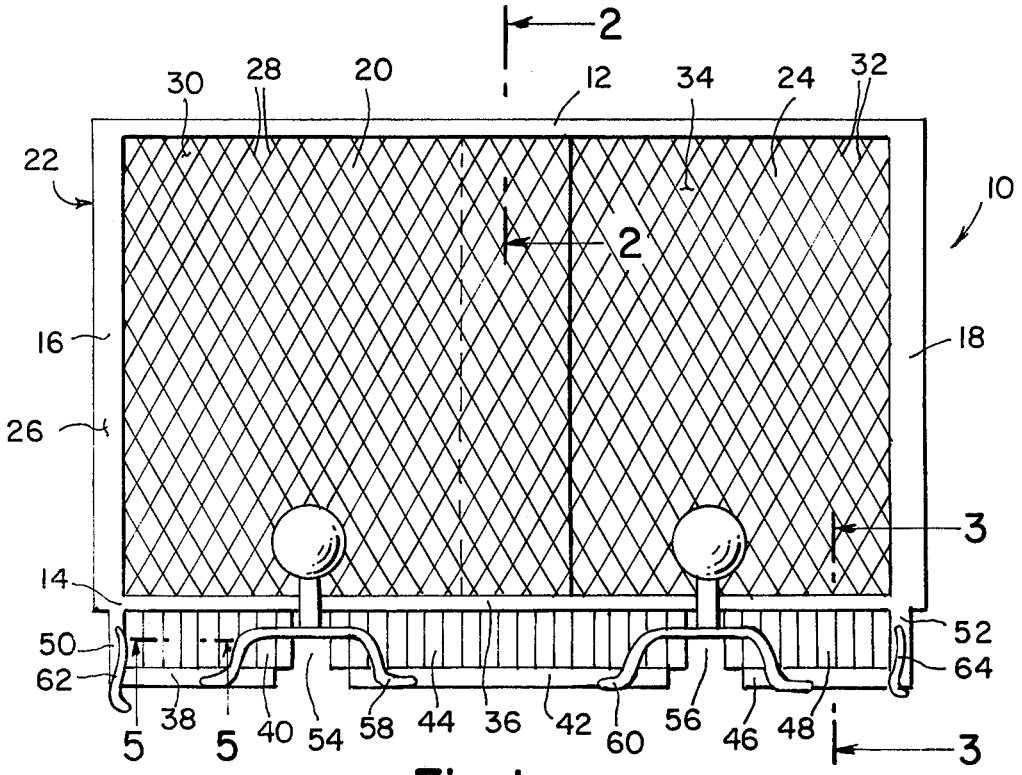
FIG. 1 is an elevation view of the present invention.

Now referring to the Figures, and more particularly to the embodiment illustrated in FIG. 1 showing the present invention 10 having uppermost track section 12, lowermost track section 14 and side tract sections 16 and 18. Rigid fire retardant sheet 20 is shown installed within the frame 22 provided by joining track sections 12, 14, 16 and 18 together into a rectangular structure. Rigid fire retardant sheet 24 is shown disposed partially behind sheet 20 and is slidably affixed within frame 22. Frontmost surface 26 of frame 22 is visible when the present invention is installed covering a fireplace opening, not shown. Indicia 28, in the form of lines simulating a wire-like screen, covers a lateral surface 30 of sheet 20. Indicia 32, in the form of lines simulating a wire-like screen, covers a lateral surface 34 of sheet 24. Track section 36 in combination with track section 38 provides guidance for pleated accordian-like member 40. Track section 36 in combination with track section 42 provides guidance for pleated accordian-like member 44. Track section 36 in combination with track section 46 provides guidance for pleated accordian-like member 48. Track sections 38 and 46 are affixed to track section 36 by way of rods 50 and 52, respectively. Track section 42 is secured to track section 36 by rods, not shown disposed behind accordian-like member 44. Accordian-like members 40, 44 and 48 are shown partially contracted or withdrawn so as to provide openings 54 and 56 facilitating the passage of portions of andirons 58 and 60. Adjacent marginal edges of members 40, 44 and 48 may be drawn into touching engagement with one another thereby closing openings 54 and 56 when andirons 58 and 60 are not employed. Legs 62 and 64 provide additional support for the present invention by resting on the hearth of the fireplace, not shown.

Figure 2:
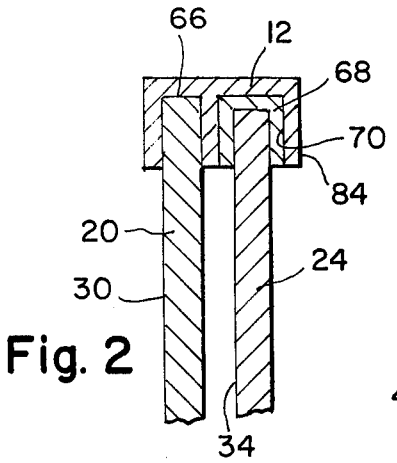
FIG. 2 is a side elevation cross-sectional view taken along line 2—2 viewed in the direction of arrows 2—2 as shown in FIG. 1.

FIG. 2 illustrates track 12 having the uppermost edge 66 of sheet 20 secured therein. Sheet 24 is provided with a U-shaped bearing member 68 which is slidably affixed within U-shaped cavity 70 in track 12.

Figure 3:
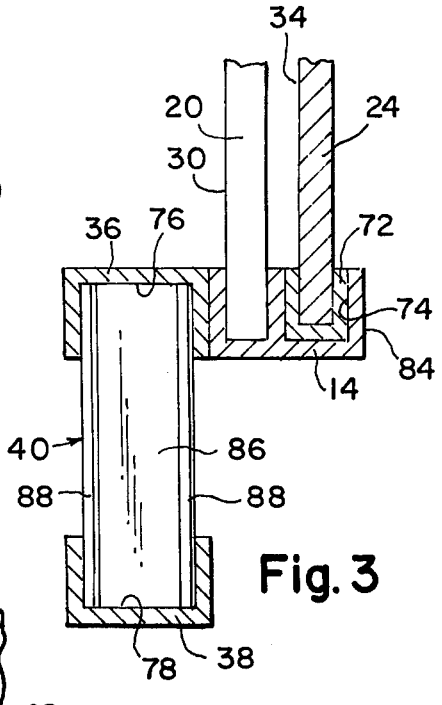
FIG. 3 is a side elevation cross-sectional view taken along line 3—3 viewed in the direction of arrows 3—3 as shown in FIG. 1.

FIG. 3 shows track 14 in which U-shaped bearing member 72 resides in U-shaped cavity 74 permitting sheet 24 to slide freely therealong. Track 36 is shown secured to track 14. Accordian-like member 40 resides within cavity 76 of track 36 and cavity 78 of track 38.

Figure 4:
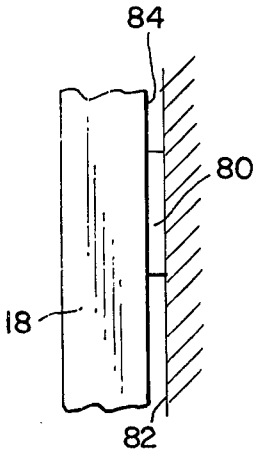
FIG. 4 is a side elevation view of a portion of the present invention and a portion of a fireplace.

FIG. 4 illustrates track member 18 to which is affixed permanent magnet 80. The magnet is shown in touching engagement with surface 82 corresponding with a ferromagnetic portion of a fireplace, not shown, providing support for track 18. It should be understood that magnets, similar to magnet 80, may be employed similarly, when attached to tracks 12, 14, 16, 36, 38, 42 and 46 on the rear surface 84 thereof.

Figure 5:
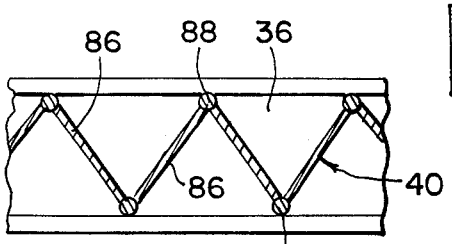
FIG. 5 is a cross-sectional plan view taken along line 5—5 viewed in the direction of arrows 5—5 as shown in FIG. 1.

FIG. 5 shows a portion of track 36 carrying accordian-like member 40. Metallic sheets 86 are pivotably secured to one another utilizing pivot rods 88 whose axes extend parallel to the adjacent marginal edges of metallic sheets 86 and parallel to surfaces 30 and 34, shown in FIG. 1.

One of the advantages of the present invention is to provide a fireplace screen which chokes the flow of air to a burning combustible within the fireplace chamber, thereby causing the combustion process to be rapidly extinguished.

Another advantage is to provide a fireplace screen which provides virtually absolute safety against flying embers forcibly leaving the fire chamber.

Still another advantage is to provide a substantially airtight fire screen which permits portions of andirons to pass through openings therein.

Yet another advantage is to provide a fireplace screen which may be magnetically removably attached to ferromagnetic elements located adjacent the fireplace chamber opening.

A further advantage is to provide a fireplace screen whose solid sheet-like surfaces carry decorative and pleasing indicia.

Another advantage is to provide a fire retarding fireplace screen which may be installed in front of a conventional screen.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein but only by the appended claims.

The embodiment of the invention in which an exclusive privilege or property is claimed are defined as follows:

I claim:

1. A fireplace screen adapted to fit over an opening of a fireplace to be in front of a fuel burning space thereof comprising:

a rigid supportive frame having front and rear face portions and including rigid top, bottom and opposite-side channel members fixedly connected to one another;

a first solid rigid sheet fixedly secured to said rigid supportive frame intermediate said front face portion and said rear face portion;

a second solid rigid sheet slidably affixed to said frame intermediate said front face portion and said rear face portion;

means to removably secure said rear face portion to a ferromagnetic material bordering said opening of said fireplace; and at least three foldable accordian-like members slidably affixed to said bottom channel member, said at least three members extensible in length providing a pair of passageways when partially fully extended and providing a substantially continuous uninterrupted surface when fully extended.

2. The fireplace screen as claimed in claim 1, wherein said removable securing means comprises a permanent magnet, said magnet fixedly secured to said rear face portion of said frame.

3. The fireplace screen as claimed in claim 1, wherein said first sheet and said second sheet carry indicia on a lateral surface thereof.

4. The fireplace screen as claimed in claim 1, wherein said first sheet and said second sheet comprise a fire retardant material.

5. The fireplace screen as claimed in claim 4, wherein said fire retardant material is asbestos board.

* * * * *